US012806676B2

(12) United States Patent
Kikuchi

(10) Patent No.: US 12,806,676 B2
(45) Date of Patent: Nov. 24, 2026

(54) HOT-STAMPING FORMED BODY

(71) Applicant: NIPPON STEEL CORPORATION, Tokyo (JP)

(72) Inventor: Shota Kikuchi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 714 days.

(21) Appl. No.: 17/800,856

(22) PCT Filed: Mar. 23, 2021

(86) PCT No.: PCT/JP2021/011957
§ 371 (c)(1),
(2) Date: Aug. 18, 2022

(87) PCT Pub. No.: WO2021/193618
PCT Pub. Date: Sep. 30, 2021

(65) Prior Publication Data

US 2023/0079854 A1 Mar. 16, 2023

(30) Foreign Application Priority Data

Mar. 27, 2020 (JP) ..... 2020-057272

(51) Int. Cl.

| | |
|---|---|
| ***B21D 22/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***C23C 2/06*** | (2006.01) |
| ***C23C 2/40*** | (2006.01) |

(52) U.S. Cl.

CPC ..... *B21D 22/022* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/14* (2013.01); *C23C 2/06* (2013.01); *C23C 2/40* (2013.01); *C21D 2211/008* (2013.01)

(58) Field of Classification Search
None
See application file for complete search history.

(56) References Cited

U.S. PATENT DOCUMENTS

| | | | | |
|---|---|---|---|---|
| 2015/0024234 | A1 | 1/2015 | Yamano et al. | |
| 2021/0040592 | A1 * | 2/2021 | Toda | C21D 8/0236 |
| 2021/0102270 | A1 * | 4/2021 | Toda | C21D 8/0205 |

FOREIGN PATENT DOCUMENTS

| | | | | |
|---|---|---|---|---|
| BR | 102014025426 | A2 * | 8/2016 | C23C 2/20 |
| JP | 05247620 | A * | 9/1993 | |
| JP | 6477980 | B1 * | 3/2019 | B32B 15/013 |
| JP | 6515360 | B1 * | 5/2019 | C21D 1/18 |
| WO | WO 2013/147228 | A1 | 10/2013 | |

OTHER PUBLICATIONS

English language machine translation of JP-05247620-A. Generated Feb. 14, 2025. (Year: 2025).*
English language machine translation of BR-102014025426-A2. Generated Mar. 13, 2026. (Year: 2026).*

* cited by examiner

*Primary Examiner* — Brian D Walck
(74) *Attorney, Agent, or Firm* — Birch, Stewart, Kolasch & Birch, LLP

(57) ABSTRACT

A hot-stamping formed body includes a steel sheet and a zinc-plated layer that is provided on the steel sheet. The steel sheet has a predetermined chemical composition, and an area % of martensite is 90% or more in microstructure at a position corresponding to ¼ of a sheet thickness of the steel sheet from a surface of the steel sheet in a sheet thickness direction. The zinc-plated layer includes a Γ phase and a Fe—Zn solid solution, and a cross-sectional area ratio of voids present in the zinc-plated layer is 15.0% or less.

6 Claims, No Drawings

HOT-STAMPING FORMED BODY

TECHNICAL FIELD OF THE INVENTION

The present invention relates to a hot-stamping formed body.

Priority is claimed on Japanese Patent Application No. 2020-057272, filed Mar. 27, 2020, the content of which is incorporated herein by reference.

BACKGROUND ART

In recent years, a need for increasing the strength of vehicle members has increased from the viewpoint of stricter collision safety criteria for vehicles and the improvement of fuel efficiency. The application of hot stamps has been extended in order to achieve an increase in the strength of vehicle members. Hot stamping is a technique for pressing a blank that is heated to a temperature ($Ac_3$ point), at which the single-phase region of austenite is formed, or more (for example, heated to about 900° C.) and then rapidly cooling the blank in a die at the same time as forming to perform quenching. According to this technique, it is possible to manufacture a press-formed product having high shape fixability and high strength.

Since a zinc component remains on the surface layer of a formed product obtained after hot stamping in a case where hot stamping is applied to a zinc-plated steel sheet, an effect of improving corrosion resistance is obtained as compared to a formed product obtained from the hot stamping of an unplated steel sheet. For this reason, the application of hot stamping to a zinc-plated steel sheet is being extended.

Patent Document 1 discloses a hot-press formed steel member manufactured by a method which includes a heating step of heating a zinc-plated steel sheet to a temperature equal to or higher than an $Ac_3$ point and a hot press forming step of performing hot press forming at least twice after the heating step and in which all the hot press forming performed in the hot press forming step are performed to satisfy a predetermined equation.

In a case where the zinc-plated steel sheet is subjected to hot stamping, electrode sticking (a phenomenon in which a copper electrode and plating provided on the surface of the formed product are melted and adhered to each other) may occur during spot welding in a formed product obtained after hot stamping. Electrode sticking during spot welding is not preferable because it could cause a poor weld or it will inevitably cause manufacturing downtime to replace the copper electrode. Electrode sticking during spot welding is not considered in Patent Document 1.

PRIOR ART DOCUMENT

Patent Document

[Patent Document 1] PCT International Publication No. WO2013/147228

DISCLOSURE OF THE INVENTION

Problems to be Solved by the Invention

The present invention has been made in consideration of the above-mentioned circumstances and an object of the present invention is to provide a hot-stamping formed body that is excellent in spot weldability. Further, an object of the present invention is to provide a hot-stamping formed body that has the above-mentioned property and has strength generally required for a hot-stamping formed body.

Means for Solving the Problem

The present inventor investigated the cause of electrode sticking during spot welding. As a result, the present inventor found that electrode sticking during spot welding is further suppressed as the number of voids present in a zinc-plated layer is smaller since electrode sticking during spot welding is greatly affected by voids (vacancy) present in the zinc-plated layer. The present inventor thought that an overcurrent occurs by a narrow electric current path caused by the voids in the zinc-plated layer, and the overcurrent causes overheating which makes electrode sticking between an electrode and zinc plating easier.

Further, although a detailed mechanism is uncertain, the present inventor thought that the occurrence of voids is caused by a difference in thermal contraction between a base metal and a zinc-plated layer and a different in thermal contraction between different phases (a phase and a Fe—Zn solid solution) present in the zinc-plated layer during hot stamping forming. As a result of the investigation of a method of suppressing the occurrence of voids, the present inventor found that a predetermined contact pressure during hot stamping forming can crush voids (i.e. the pressure can reduce the number density of voids present in the zinc-plated layer), and that results in improving spot weldability. Excellent spot weldability means that electrode sticking during spot welding can be suppressed. Further, tensile (maximum) strength generally required for a hot-stamping formed body is in a range of 1500 MPa to 2500 MPa.

The gist of the present invention made on the basis of the above-mentioned knowledge is as follows.

[1] A hot-stamping formed body according to an aspect of the present invention includes a steel sheet and a zinc-plated layer that is provided on the steel sheet. The steel sheet has a chemical composition containing, by mass %, C: 0.18% to 0.50%, Si: 0.10% to 1.50%, Mn: 1.5% to 2.5%, sol.Al: 0.001% to 0.100%, Ti: 0.010% to 0.100%, S: 0.0100% or less, P: 0.100% or less, N: 0.010% or less, Nb: 0% to 0.05%, V: 0% to 0.50%, Cr: 0% to 0.50%, Mo: 0% to 0.50%, B: 0% to 0.010%, Ni: 0% to 2.00%, and a total of REM, Ca, Co, and Mg: 0% to 0.030%. A remainder consists of Fe and impurities, an area % of martensite is 90% or more in microstructure at a position corresponding to ¼ of a sheet thickness of the steel sheet from a surface of the steel sheet in a sheet thickness direction, the zinc-plated layer includes a Γ phase and a Fe—Zn solid solution, and a cross-sectional area ratio of voids present in the zinc-plated layer is 15.0% or less.

[2] In the hot-stamping formed body according to [1], the chemical composition may contain, by mass %, one or two or more selected from the group consisting of Nb: 0.02% to 0.05%, V: 0.005% to 0.50%, Cr: 0.10% to 0.50%, Mo: 0.005% to 0.50%, B: 0.0001% to 0.010%, Ni: 0.01% to 2.00%, and a total of REM, Ca, Co, and Mg: 0.0003% to 0.030%.

[3] In the hot-stamping formed body according to [1] or [2], the chemical composition may contain, by mass %, C: 0.24% to 0.50%.

Effects of the Invention

According to the aspect of the present invention, it is possible to provide a hot-stamping formed body that is excellent in spot weldability and has strength generally required for a hot-stamping formed body.

EMBODIMENTS OF THE INVENTION

A hot-stamping formed body according to this embodiment will be described in detail below. First, the reason why the chemical composition of a steel sheet of the hot-stamping formed body according to this embodiment is to be limited will be described. All percentages (%) related to the chemical composition mean mass %.

A steel sheet of the hot-stamping formed body according to this embodiment contains, by mass %: C: 0.18% to 0.50%; Si: 0.10% to 1.50%; Mn: 1.5% to 2.5%; sol. Al: 0.001% to 0.100%; Ti: 0.010% to 0.100%; S: 0.0100% or less; P: 0.100% or less; N: 0.010% or less; and a remainder consisting of Fe and impurities. Each element will be described below.

C: 0.18% to 0.50%

C is an element that improves the strength of the hot-stamping formed body. The C content is set to 0.18% or more in order to obtain a desired strength. The C content is preferably 0.20% or more and more preferably 0.24% or more. On the other hand, in a case where the C content exceeds 0.50%, strength is excessively high, so that the ductility and toughness of the hot-stamping formed body deteriorate. For this reason, the C content is set to 0.50% or less. The C content is preferably 0.40% or less.

Si: 0.10% to 1.50%

Si is an element that improves a fatigue property. Further, Si is also an element that improves a hot-dip galvanizing property, particularly plating wettability, by forming a stable oxide film on the surface of the steel sheet during recrystallization annealing. In order to obtain these effects, the Si content is set to 0.10% or more. The Si content is preferably 0.15% or more. On the other hand, in a case where the Si content is excessively high, Si contained in steel is diffused during heating at the time of hot stamping and forms oxide on the surface of the steel sheet. The oxide formed on the surface of the steel sheet deteriorates a phosphate treatment property. Further, Si is also an element that raises the $Ac_3$ point of the steel sheet. In a case where the $Ac_3$ point is raised, a heating temperature needs to be raised in order to sufficiently austenitize the steel sheet and a heating temperature during hot stamping exceeds the evaporation temperature of zinc plating. For this reason, the Si content is set to 1.50% or less. The Si content is preferably 1.40% or less.

Mn: 1.5% to 2.5%

Mn is an element that improves the hardenability of steel. The Mn content is set to 1.5% or more in order to improve hardenability and obtain a desired amount of martensite. The Mn content is preferably 1.8% or more. On the other hand, even though the Mn content exceeds 2.5%, an effect of improving hardenability is saturated and steel is embrittled, so that quenching cracks are likely to occur during casting, hot rolling, and cold rolling. For this reason, the Mn content is set to 2.5% or less. The Mn content is preferably 2.1% or less.

sol. Al: 0.001% to 0.100%

Al is an element that deoxidizes molten steel to suppress the formation of oxide serving as the origin of fracture. Further, Al is also an element that suppresses an alloying reaction between Zn and Fe and improves corrosion resistance. In order to obtain these effects, the sol.Al content is set to 0.001% or more. The sol.Al content is preferably 0.005% or more. On the other hand, in a case where the sol.Al content is excessive, the $Ac_3$ point of the steel sheet is raised, a heating temperature needs to be raised in order to sufficiently austenitize the steel sheet, and a heating temperature during hot stamping exceeds the evaporation temperature of zinc plating. For this reason, the sol.Al content is set to 0.100% or less. The sol.Al content is preferably 0.090% or less.

In this embodiment, sol.Al means acid-soluble Al, and indicates solute Al that is present in steel in the state of a solid solution.

Ti: 0.010% to 0.100%

Ti is an element that increases oxidation resistance after galvanizing. Further, Ti is also an element that improves hardenability by combining with N to form nitride (TiN) and suppressing the formation of nitride (BN) from B. In order to obtain these effects, the Ti content is set to 0.010% or more. The Ti content is preferably 0.020% or more. On the other hand, in a case where the Ti content is excessive, the $Ac_3$ point is raised and a heating temperature during hot stamping is raised. For this reason, productivity may deteriorate, and it may be difficult to secure a Γ phase since formation into a Fe—Zn solid solution may be facilitated. Further, in a case where the Ti content is excessive, a large amount of Ti carbide is formed and the amount of solute C is reduced, so that strength is reduced. Furthermore, the wettability of plating may deteriorate, and toughness may deteriorate due to the excessive precipitation of Ti carbide. For this reason, the Ti content is set to 0.100% or less. The Ti content is preferably 0.070% or less.

S: 0.0100% or Less

S is an element that is contained as an impurity and is an element that forms sulfide in steel to cause the deterioration of toughness and to deteriorate a delayed fracture resistance property. For this reason, the S content is set to 0.0100% or less. The S content is preferably 0.0050% or less. It is preferable that the S content is 0%. However, since cost required to remove S is increased in a case where the S content is to be excessively reduced, the S content may be set to 0.0001% or more.

P: 0.100% or Less

P is an element that is included as an impurity, and is an element that segregates at a grain boundary to deteriorate toughness and a delayed fracture resistance property. For this reason, the P content is set to 0.100% or less. The P content is preferably 0.050% or less. It is preferable that the P content is 0%. However, since cost required to remove P is increased in a case where the P content is to be excessively reduced, the P content may be set to 0.001% or more.

N: 0.010% or Less

N is an impurity element, and is an element that forms coarse nitride in steel to deteriorate the toughness of steel. Further, N is also an element that facilitates the occurrence of blow holes during spot welding. Furthermore, in a case where B is contained, N combines with B to reduce the amount of solute B and deteriorates hardenability. For this reason, the N content is set to 0.010% or less. The N content is preferably 0.007% or less. It is preferable that the N content is 0%. However, since manufacturing cost is increased in a case where the N content is to be excessively reduced, the N content may be set to 0.0001% or more.

The remainder of the chemical composition of the steel sheet of the hot-stamping formed body according to this embodiment is Fe and impurities. Elements, which are unavoidably mixed from a steel raw material or scrap and/or during the manufacture of steel and are allowed in a range where the properties of the hot-stamping formed body according to this embodiment do not deteriorate, are exemplified as the impurities.

The steel sheet of the hot-stamping formed body according to this embodiment may contain the following elements as arbitrary elements instead of a part of Fe. The contents of the following arbitrary elements in a case where the following arbitrary elements are not contained are 0%.

Nb: 0% to 0.05%

Nb is an element that forms carbide in steel to refine crystal grains during hot stamping and improves the toughness of the hot-stamping formed body. In order to reliably obtain this effect, it is preferable that the Nb content is set to 0.02% or more. On the other hand, even though the Nb content exceeds 0.05%, the above-mentioned effect is saturated and hardenability deteriorates. For this reason, the Nb content is set to 0.05% or less.

V: 0% to 0.50%

V is an element that finely forms carbonitride in steel to improve strength. In order to reliably obtain this effect, it is preferable that the V content is set to 0.005% or more. On the other hand, in a case where the V content exceeds 0.50%, the toughness of steel deteriorates during spot welding and cracks are likely to occur. For this reason, the V content is set to 0.50% or less.

Cr: 0% to 0.50%

Cr is an element that improves the hardenability of steel. In order to reliably obtain this effect, it is preferable that the Cr content is set to 0.10% or more. On the other hand, in a case where the Cr content exceeds 0.50%, Cr carbide is formed in steel and it is difficult for Cr carbide to be dissolved during heating of hot stamping, so that hardenability deteriorates. For this reason, the Cr content is set to 0.50% or less.

Mo: 0% to 0.50%

Mo is an element that improves the hardenability of steel. In order to reliably obtain this effect, it is preferable that the Mo content is set to 0.005% or more. On the other hand, even though the Mo content exceeds 0.50%, an effect of improving hardenability is saturated. For this reason, the Mo content is set to 0.50% or less.

B: 0% to 0.010%

B is an element that improves the hardenability of steel. In order to reliably obtain this effect, it is preferable that the B content is set to 0.0001% or more. On the other hand, even though the B content exceeds 0.010%, an effect of improving hardenability is saturated. For this reason, the B content is set to 0.010% or less.

Ni: 0% to 2.00%

Ni is an element that has an effect of improving the toughness of steel, an effect of suppressing the embrittlement of steel caused by liquid Zn during heating of hot stamping, and an effect of improving the hardenability of steel. In order to reliably obtain these effects, it is preferable that the Ni content is set to 0.01% or more. On the other hand, even though the Ni content exceeds 2.00%, the above-mentioned effects are saturated. For this reason, the Ni content is set to 2.00% or less.

Total of REM, Ca, Co, and Mg: 0% to 0.030%

REM, Ca, Co, and Mg are elements that suppress the occurrence of cracks during spot welding by controlling sulfide and oxide in a preferred shape and suppressing the formation of coarse inclusions. In order to reliably obtain this effect, it is preferable that the total content of REM, Ca, Co, and Mg is set to 0.0003% or more. In order to reliably obtain the above-mentioned effect, the content of even any one of REM, Ca, Co, and Mg may be 0.0003% or more. On the other hand, in a case where the total content of REM, Ca, Co, and Mg exceeds 0.030%, inclusions are excessively generated and cracks are likely to occur during spot welding. For this reason, the total content of REM, Ca, Co, and Mg is set to 0.030% or less.

In this embodiment. REM refers to a total of 17 elements that are composed of Sc, Y, and lanthanoid and the REM content refers to the total content of these elements.

The chemical composition of the steel sheet described above may be measured by a general analysis method. For example, the chemical composition of the steel sheet described above may be measured using inductively coupled plasma-atomic emission spectrometry (ICP-AES). C and S may be measured using a combustion-infrared absorption method and N may be measured using an inert gas fusion-thermal conductivity method. Further, sol.Al may be measured by ICP-AES using a filtrate that is obtained in a case where a sample is decomposed with an acid by heating. The chemical composition may be analyzed after the zinc-plated layer provided on the surface of the hot-stamping formed body may be removed by mechanical grinding.

Next, the microstructure of the steel sheet of the hot-stamping formed body according to this embodiment will be described.

In the microstructure of the steel sheet of the hot-stamping formed body according to this embodiment at a position corresponding to ¼ of a sheet thickness from the surface of the steel sheet in a sheet thickness direction, the area % of martensite is 90% or more.

In this embodiment, microstructure at a position corresponding to ¼ of a sheet thickness from the surface of the steel sheet in a sheet thickness direction (a region between a position corresponding to ⅛ of a sheet thickness from the surface of the steel sheet and a position corresponding to ⅜ of a sheet thickness from the surface of the steel sheet) is specified. The reason for this is that this depth position is an intermediate point between the surface of the steel sheet and a central position of the sheet thickness and microstructure at this depth position typifies the steel structure of the steel sheet (shows the average microstructure of the entire steel sheet).

Martensite: 90% or More

Martensite is structure that improves the strength of the steel sheet. In a case where the area ratio of martensite is less than 90%, a desired strength cannot be obtained in the hot-stamping formed body. For this reason, the area ratio of martensite is set to 90% or more. The area ratio of martensite is preferably 95% or more or 96% or more. Since higher area ratio of martensite is more preferable, the upper limit of the area ratio of martensite may be set to 100%.

Ferrite, pearlite, bainite, and residual austenite are included in the microstructure of the steel sheet of the hot-stamping formed body according to this embodiment as a remainder in microstructure. Since a desired strength cannot be obtained in a case where the area ratio of the remainder in microstructure is high, the area ratio of the remainder in microstructure may be set to 10% or less. The area ratio of the remainder in microstructure is preferably 5% or less, more preferably 4%, and still more preferably 0%.

The area ratio of martensite is measured by the following method.

A sample is cut out from an arbitrary position away from an end surface of the hot-stamping formed body by a distance of 50 mm or more (a position that avoids an end portion in a case where the sample cannot be taken from this position) so that a cross section (sheet thickness-cross section) perpendicular to the surface can be observed. The size of the sample also depends on a measurement device but is set to a size that allows the size to be observed by about 10 mm in a rolling direction. In a case where the hot-stamping formed body includes a welded portion, a sample is taken from a position avoiding the welded portion and the vicinity of the welded portion.

The cross section of the sample is etched using LePera reagent. A position corresponding to t/4 (t denotes the sheet thickness) of the cross section etched using LePera reagent (a region between a position corresponding to ⅛ of a sheet thickness from the surface of the sample and a position corresponding to ⅜ of a sheet thickness from the surface of the sample) is observed in 10 visual fields with a magnification of 500, and image analysis is performed on an obtained optical microscopy image by using image analysis software of "Photoshop CSS" manufactured by Adobe Systems Inc. to obtain the area ratio of martensite. As an image analysis method, the maximum luminosity value $L_{max}$ and the minimum luminosity value $L_{min}$ of an image are acquired from the image, a portion including pixels having luminosity in a range of $L_{max}-0.3(L_{max}-L_{min})$ to $L_{max}$ is defined as a white region, a portion including pixels having luminosity in a range of $L_{min}$ to $L_{min}+0.3(L_{max}-L_{min})$ is defined as a black region, other portions are defined as a gray region, and the area ratio of martensite, which is a white region, is calculated. Image analysis is performed in the same manner as described above for a total of 10 observed visual fields to measure the area ratios of martensite, and these area ratios are averaged to calculate an average value. The obtained average value is regarded as the area ratio of martensite. As result, the area ratio of martensite is obtained.

Further, the area ratio of martensite is subtracted from 100% to obtain the area ratio of the remainder in microstructure.

Next, a zinc-plated layer forming the hot-stamping formed body according to this embodiment will be described. The zinc-plated layer is provided on the above-mentioned steel sheet and includes a Γ phase and a Fe—Zn solid solution, and the cross-sectional area ratio of voids present in the zinc-plated layer is 15.0% or less. The zinc-plated layer may be provided on both surfaces or any one surface of the above-mentioned steel sheet. Further, the zinc-plated layer refers to a layer in which the Γ phase and the Fe—Zn solid solution are present. The Γ phase and the Fe—Zn solid solution will be described later.

The zinc-plated layer will be described below.

Including Γ Phase and Fe—Zn Solid Solution

The zinc-plated layer includes the Γ phase and the Fe—Zn solid solution. The Γ phase is a layer that has a Zn concentration close to the Zn concentration of a zinc bath. The Fe—Zn solid solution is a phase that is generated in a case where zinc present in the zinc bath and Fe contained in the steel sheet are alloyed with each other. For this reason, the Fe concentration of the Γ phase is lower than that of the Fe—Zn solid solution. In this embodiment, a phase of which the Fe concentration is in a range of 10 mass % to 30 mass % is defined as the F phase, and a phase of which the Fe concentration is in a range of 50 mass % to 80 mass % is defined as the Fe—Zn solid solution. A $\delta_1$ phase and a ξ phase may be included in the zinc-plated layer in addition to the Γ phase and the Fe—Zn solid solution. The Fe concentration of each of the $\delta_1$ phase and the ξ phase is less than 10 mass %.

In a case where the Γ phase is not included in the zinc-plated layer due to the excessive alloying of the zinc-plated layer, corrosion resistance deteriorates as compared to a zinc-plated layer including the Γ phase. Further, the fact that the Γ phase is not included in the zinc-plated layer means that the zinc-plated layer is being alloyed. As the zinc-plated layer is alloyed (in a case where the zinc-plated layer is an alloyed zinc-plated layer), an oxide film (ZnO) is formed and grows on the surface of plating, which increases contact resistance during spot welding. As a result, expulsion is likely to occur. For this reason, it is important that the Γ phase is included in the zinc-plated layer.

Since the properties of the hot-stamping formed body according to this embodiment can be exhibited as long as even a small amount of the Γ phase is included in the zinc-plated layer, the ratio of the Γ phase in the zinc-plated layer is not particularly limited. The adhesion amount of the zinc-plated layer depends on a desired corrosion resistance target, but may be set in a range of, for example, 5 g/m$^2$ to 150 g/m$^2$ per side. However, for example, in order to secure corrosion resistance equal to or higher than the corrosion resistance of a cold formed article of a zinc-plated steel sheet, the amount of the Γ phase may be set to 30 g/m$^2$ or more per side. The reason for this is that, since the Fe—Zn solid solution generated by heating during quenching causes Fe rust and increases in volume in a case where the amount of the Γ phase is less than 30 g/m$^2$, Zn oxidized during corrosion does not form a dense protective film and corrosion resistance equal to or higher than the corrosion resistance of a cold formed article of the zinc-plated steel sheet may not be obtained.

The analysis of a Fe concentration in the zinc-plated layer is performed using the following method.

A sample is cut out from an arbitrary position away from an end surface of the hot-stamping formed body by a distance of 50 mm or more (a position that avoids an end portion in a case where the sample cannot be taken from this position) so that a cross section (sheet thickness-cross section) perpendicular to the surface can be observed. The size of the sample also depends on a measurement device but is set to a size that allows the size to be observed by about 10 mm in a rolling direction. In a case where the hot-stamping formed body includes a welded portion, a sample is taken from a position avoiding the welded portion and the vicinity of the welded portion.

After the sample is embedded in a resin and is polished, the layer structure of a sheet thickness-cross section is observed with a scanning electron microscope (SEM). Specifically, the layer structure of the sheet thickness-cross section is observed using the SEM with a magnification in which the steel sheet and the zinc-plated layer are included in an observed visual field. Then, linear analysis is performed in a sheet thickness direction from the surface using an SEM-energy dispersive X-ray spectroscopy (SEM-EDS) in order to specify each layer in the layer structure of the sheet thickness-cross section, and the quantitative analysis of the Fe concentration of each layer is performed. Linear analysis is performed in the observation cross section of the sample at 100 points arranged at intervals of 0.1 μm in a direction parallel to the surface. In the linear analysis, quantitative analysis is performed at intervals of 1 nm in the sheet thickness direction by energy dispersive X-ray spectroscopy (EDS) in which the diameter of an electron beam is set to 10 nm. A phase of which the Fe concentration is in a range of 10 mass % to 30 mass % is defined as the Γ phase, and a phase of which the Fe concentration is in a range of 50 mass % to 80 mass % is defined as the Fe—Zn solid solution. Phases of which the Fe concentration is less than 10 mass % are defined as the $\delta_1$ phase and the ξ phase.

Next, linear analysis is performed in the sheet thickness direction using an SEM-energy dispersive X-ray spectroscopy (EDS), and the quantitative analysis of the Fe concentration of each layer is performed. A device to be used is not particularly limited, but, for example, SEM (NB5000 manufactured by Hitachi High-Tech Corporation), EDS (XFlash® 6|30 manufactured by Bruker AXS Inc.), and EDS analysis software (ESPRIT1.9 manufactured by Bruker AXS Inc.) may be used in this embodiment. From the observation results of the COMPO image and the quantitative analysis results of SEM-EDS described above, a region, which is present at the deepest position in the sheet thickness direction and in which the Fe content exceeds 80 mass % excluding measurement noise, is determined as a steel sheet. Further, a phase of which the Fe content is in a range of 10 mass % to 30 mass % excluding measurement noise is determined as the Γ phase, and a region of which the Fe concentration is in a range of 50 mass % to 80 mass % is determined as the Fe—Zn solid solution.

Next, a method of measuring the Γ phase included in the zinc-plated layer will be described. A test piece is taken from the hot-stamping formed body, and this test piece is immersed in an aqueous solution of $NH_4Cl$:150 g/l. Constant-current electrolysis is performed with 4 mA/cm$^2$ using a saturated calomel electrode as a reference electrode, and a range in which an electric potential is −800 mV vs. SCE or less is regarded as the Γ phase. The reason for this is that this range can be regarded as the Γ phase which contains Zn as a main component and in which the Fe content is 30 mass % or less. An electrolyte obtained from the electrolysis of the Γ phase is measured using inductively coupled plasma (ICP), and the sum of the amount of Fe and the amount of Zn is regarded as the amount of the Γ phase.

Cross-Sectional Area Ratio of Voids Present in Zinc-Plated Layer: 15.0% or Less

In a case where the cross-sectional area ratio of voids present in the zinc-plated layer is set to 15.0% or less, it is possible to suppress electrode sticking during the spot welding of the hot-stamping formed body. The present inventor thought that electrode sticking is likely to occur in a case where the cross-sectional area ratio of the voids exceeds 15.0%, which means that an electric current path is locally narrow enough to cause an overcurrent leading to overheating during spot welding. For this reason, in this embodiment, the cross-sectional area ratio of voids present in the zinc-plated layer of at least a region, which serves as a portion to be welded, is set to 15.0% or less. The cross-sectional area ratio of voids present in the zinc-plated layer is preferably 13.0% or less, more preferably 10.0% or less, and still more preferably 5.0% or less. Since lower cross-sectional area ratio of voids present in the zinc-plated layer is more preferable, the lower limit of the cross-sectional area ratio of voids present in the zinc-plated layer may be set to 0%.

The cross-sectional area ratio of voids present in the zinc-plated layer is measured using the following method.

First, a sample is cut out from an arbitrary position away from an end surface of the hot-stamping formed body by a distance of 50 mm or more (a position that avoids an end portion in a case where the sample cannot be taken from this position) so that a cross section (sheet thickness-cross section) perpendicular to the surface can be observed. The size of the sample also depends on a measurement device but is set to a size that allows the size to be observed by about 10 mm in a rolling direction.

Next, after an observation cross section is polished and is imaged using a scanning electron microscope (SEM) with a magnification of 300, the cross-sectional area ratio of voids is calculated using binarization image processing. A device used for the calculation of the cross-sectional area ratio of voids is not particularly limited, but, for example, the built-in software of a digital microscope VHX-5000 manufactured by Keyence Corporation may be used to determine the voids using luminance and to automatically measure the area of the voids.

The cross-sectional area ratio of voids present in the zinc-plated layer is obtained using the above-mentioned method.

Sheet Thickness and Tensile Strength

The sheet thickness of the hot-stamping formed body according to this embodiment is not particularly limited. However, in terms of reducing the weight of a vehicle body, it is preferable that the sheet thickness of the hot-stamping formed body according to this embodiment is set in a range of 0.5 mm to 3.5 mm.

Further, in terms of reducing the weight of a vehicle body, it is preferable that the tensile strength of the hot-stamping formed body is set to 1500 MPa or more. On the other hand, in a case where the tensile strength exceeds 2500 MPa, strength is excessively high, so that the toughness and ductility of the hot-stamping formed body may deteriorate. For this reason, it is preferable that the tensile strength is set to 2500 MPa or less.

Next, a method of manufacturing the hot-stamping formed body according to this embodiment will be described.

A steel sheet (zinc-plated steel sheet) including a zinc-plated layer on the surface thereof is subjected to hot stamping to apply predetermined contact pressure and is then cooled, so that the hot-stamping formed body according to this embodiment is manufactured. Since the Γ phase included in a zinc-plated layer disappears (during the alloying of zinc plating) in a case where a hot-dip galvannealed layer is used, an effect of improving corrosion resistance is not obtained. For this reason, it is preferable that the zinc-plated steel sheet may be a hot-dip zinc-plated steel sheet.

First, a method of manufacturing the zinc-plated steel sheet will be described. After a cast piece having cast is heated to 1200° C. or more and is held for 20 minutes or more, hot rolling is performed so that a finish rolling completion temperature is 810° C. or more. Further, cold rolling is performed to manufacture a steel sheet having the above-mentioned chemical composition and a zinc-plated layer is then formed on the surface of the steel sheet by a continuous hot-dip galvanizing line, so that the zinc-plated steel sheet is manufactured. A cumulative rolling reduction during the cold rolling may be set in a range of 30% to 90%. In the method of manufacturing the zinc-plated steel sheet, the annealing of a hot-rolled sheet may be performed between the hot rolling and the cold rolling. Further, pickling may be performed. The cold rolling may be omitted and a steel sheet subjected to the hot rolling may be introduced into the continuous hot-dip galvanizing line. In a case where the cold rolling is omitted, the annealing of a hot-rolled sheet and the pickling may be omitted.

In the continuous hot-dip galvanizing line, the steel sheet is heated and held and is then immersed in a hot-dip galvanizing bath, so that a zinc-plated layer is formed on the surface of the steel sheet. The adhesion amount of the zinc-plated layer may be set in a range of 5 g/m$^2$ to 150 g/m$^2$ per side. Since electrogalvanizing requires additional elements for delaying alloying, which increases manufacturing cost, electrogalvanizing is not desirable.

Next, the zinc-plated steel sheet is heated so that a heating temperature is in a range of higher one of "the $Ac_3$ point and 800° C." to 950° C. Further, a heating time (a time that has passed until the zinc-plated steel sheet is out of a heating furnace after being put in the heating furnace and then held at the heating temperature (a time having passed between carrying the zinc-plated steel sheet in the heating furnace and carrying the zinc-plated steel sheet out the heating furnace)) is set in a range of 60 sec to 600 sec. The $Ac_3$ point is represented by the following equation (1). In a case where the heating temperature is lower than higher one of "the $Ac_3$ point and 800° C." or the heating time is less than 60 sec, the zinc-plated steel sheet cannot be sufficiently austenitized. As a result, a desired amount of martensite cannot be obtained. In a case where the heating temperature exceeds 950° C. or the heating time exceeds 600 sec, the Γ phase included in a zinc-plated layer disappears due to the excessive alloying of the zinc-plated steel sheet. An average heating rate during heating may be set in a range of 0.1° C./s to 200° C./s. The average heating rate mentioned here is a value that is obtained in a case where a temperature difference between the surface temperature of the steel sheet at the time of start of the heating and the heating temperature is divided by a time difference from the start of the heating to a time when a temperature reaches the heating temperature. In a case where the steel sheet is held in a temperature range of higher one of "the $Ac_3$ point and 800° C." to 950° C., the temperature of the steel sheet may be changed or constant.

Examples of a heating method to be performed before the hot stamping include heating using an electric furnace, a gas furnace, or the like, flame heating, electrical resistance heating, high-frequency heating, induction heating, and the like.

$$Ac_3(°\ C.)=910-203\times C^{0.5}-30\times Mn+44.7\times Si+400\times Ti \quad (1)$$

A symbol of an element in Equation (1) represents the content of each element by mass %.

Hot stamping is performed after the heating and the holding described above. After the hot stamping, it is preferable that cooling is performed at an average cooling rate of 20° C./s or more up to a temperature range of 250° C. or less. In a case where a cooling stop temperature is higher than 250° C. or an average cooling rate is lower than 20° C./s in the cooling to be performed after the hot stamping, a desired amount of martensite cannot be obtained. Since the addition of cooling equipment is required and manufacturing cost is increased in a case where an average cooling rate is set to exceed 500° C./s, an average cooling rate may be set to 500° C./s or less. The average cooling rate mentioned here is a value that is obtained in a case where a temperature difference between the surface temperature of the steel sheet at the time of start of the cooling and the cooling stop temperature is divided by a time difference from the start of the cooling to a time when the cooling is stopped.

A cooling rate after the cooling is performed up to a temperature range of 250° C. or less is not particularly limited, and examples of a cooling method include air cooling.

In this embodiment, a contact pressure of 50 MPa or more is applied to the zinc-plated steel sheet during hot stamping. Since a contact pressure of 50 MPa or more is applied, voids present in the zinc-plated layer are crushed and the cross-sectional area ratio of the voids can be reduced. Accordingly, it is possible to suppress the occurrence of electrode sticking during the spot welding of the hot-stamping formed body. In a case where a contact pressure is lower than 50 MPa, the cross-sectional area ratio of the voids present in the zinc-plated layer cannot be sufficiently reduced. It is preferable that a contact pressure to be applied during hot stamping is set to 100 MPa or more.

In a case where the contact pressure is excessively high, a lot of irregularities are formed on the surface of the hot-stamping formed body due to surface abrasion between a die and oxide scale formed on the surface of a steel sheet for hot stamping. For this reason, there is a concern that weldability deteriorates. From this point of view, it is preferable that the contact pressure is set to 500 MPa or less. Further, in a case where the contact pressure exceeds 200 MPa, hot-stamping equipment may be damaged due to excessively high contact pressure. For this reason, it is preferable that the contact pressure is set to 200 MPa or less.

In order to reduce the cross-sectional area ratio of the voids present in the zinc-plated layer, it is important to control contact pressure during hot stamping as in this embodiment. For example, even though pressing is performed again after hot stamping and a contact pressure to be applied during this pressing is controlled, the cross-sectional area ratio of the voids present in the zinc-plated layer cannot be reduced.

It is desirable that a region of the zinc-plated steel sheet to which a contact pressure of 50 MPa or more is to be applied is set to a region to be welded (a region serving as a portion to be welded) after the forming of the hot-stamping formed body. The reason for this is that it is possible to reduce the occurrence of electrode sticking during spot welding in a case where the cross-sectional area ratio of voids is reduced in a region, which is to be welded, of the hot-stamping formed body.

EXAMPLES

Next, examples of the present invention will be described. Conditions in the examples are one condition example that is employed to confirm the feasibility and effects of the present invention, and the present invention is not limited to this condition example. The present invention may employ various conditions to achieve the object of the present invention without departing from the scope of the present invention.

After steel pieces manufactured from the casting of molten steel having the chemical composition shown in Table 1 were heated to 1200° C. or more and were held for 20 minutes or more, hot rolling was performed so that a finish rolling completion temperature was 810° C. or more and cold rolling was further performed. As a result, steel sheets were obtained. A cumulative rolling reduction during the cold rolling was set in a range of 30% to 90%. Zinc plating was applied to the obtained steel sheets by a continuous hot-dip galvanizing line, so that zinc-plated steel sheets (hot-dip zinc-plated steel sheets) were obtained. The adhesion amount of a zinc-plated layer was set in a range of 5 $g/m^2$ to 150 $g/m^2$ per side. Hot-stamping formed bodies shown in Tables 2 and 3 were manufactured using the obtained zinc-plated steel sheets under conditions shown in Tables 2 and 3. An average heating rate during the heating performed before hot stamping was set in a range of 0.1° C./s to 200° C./s.

An underline in Tables represents that a condition is out of the range of the present invention, a condition is out of a preferred manufacturing condition, or a property value is not preferred.

With regard to the microstructure of the steel sheet of each hot-stamping formed body, the measurement of the area ratio of each structure was performed by the above-mentioned measurement method. Ferrite, pearlite, and bainite were observed as the remainder in microstructure other than martensite.

Further, the layer structure of the zinc-plated layer of the hot-stamping formed body was analyzed using the above-mentioned method, and the cross-sectional area ratio of voids present in the zinc-plated layer was measured using the above-mentioned method. In a case where a r phase was observed in the zinc-plated layer, "presence" was written in Tables. In a case where the Γ phase was not observed in the zinc-plated layer, "absence" was written in Tables. The zinc-plated layer of Example where "presence" was written in Tables with regard to the zinc-plated layer included a Fe—Zn solid solution in addition to the Γ phase, and the adhesion amount of the Γ phase was in a range of 5 g/m$^2$ to 150 g/m$^2$ per side.

The mechanical properties (tensile strength and spot weldability) of each hot-stamping formed body were evaluated using the following methods.

Tensile Strength

No. 5 test pieces described in JIS Z 2241:2011 were prepared from an arbitrary position of the hot-stamping formed body, and the tensile strength of the hot-stamping formed body was obtained according to a test method described in JIS Z 2241:2011. In a case where the tensile strength was in a range of 1500 MPa to 2500 MPa, the test piece was determined to be acceptable since having strength generally required for a hot-stamping formed body. Further, in a case where the tensile strength was less than 1500 MPa, the test piece was determined to be unacceptable since being insufficient in strength. Furthermore, in a case where the tensile strength exceeded 2500 MPa, the test piece was determined to be unacceptable since being insufficient in toughness and ductility due to excessively high strength.

Spot Weldability

With regard to the hot-stamping formed body, two test pieces having a size of 100 mm×30 mm were taken from a position excluding a region within 10 mm from an end surface, these test piece overlapped with each other, and spot welding was performed while current was changed under the following conditions.

Electrode force: 400 kgf
Weld time: 15 cycles
Holding time: 9 cycles
Shape of electrode tip: DR type, tip ϕ 6 mm-radius of curvature of R40 mm Spot welding was performed while current was increased from a current $I_0$ at which a nugget diameter was $4\sqrt{t}$ (t denotes the sheet thickness of the test piece) to obtain a current at which expulsion occurred and a current at which electrode sticking occurred (electrode sticking current $I_s$). A range between $I_0$ and the current at which expulsion occurred was set as an appropriate current range. In a case where molten metal was splashed, it was determined that expulsion occurred. In a case where expulsion occurred when spot welding was performed at the current $I_0$ at which a nugget diameter was $4\sqrt{t}$, it was regarded that there was no appropriate current range and "–" was written in Table 3. An example in which there was no appropriate current range was determined to be unacceptable since being inappropriate as a zinc-plated steel sheet for spot welding.

Further, spot weldability with regard to the obtained electrode sticking current $I_s$ was evaluated on the basis of the following criteria. Here, $I_0$(kA) is the current at which a nugget diameter was $4\sqrt{t}$ (t denotes the sheet thickness of the test piece), and $I_a$(kA) is "$I_0 \times 1.4$". Examples evaluated as good and fair were determined to be acceptable since being excellent in spot weldability. On the other hand, an example evaluated as bad was determined to be unacceptable since being insufficient in spot weldability.

Good: $I_s > I_a \times 1.15$
Fair: $I_a \times 1.10 < I_s \leq I_a \times 1.15$
Bad: $I_s \leq I_a \times 1.10$

TABLE 1

| Steel | Chemical composition (mass %) Remainder Fe and impurities | | | | | | | | | $Ac_3$ | |
|---|---|---|---|---|---|---|---|---|---|---|---|
| No. | C | Si | Mn | sol. Al | Ti | S | P | N | Others | (° C.) | Note |
| 1 | 0.19 | 0.20 | 2.4 | 0.030 | 0.025 | 0.0020 | 0.004 | 0.003 | | 768 | Steel of present invention |
| 2 | 0.49 | 0.15 | 2.0 | 0.030 | 0.035 | 0.0020 | 0.010 | 0.003 | | 729 | Steel of present invention |
| 3 | 0.31 | 0.10 | 1.8 | 0.040 | 0.025 | 0.0020 | 0.010 | 0.003 | | 757 | Steel of present invention |
| 4 | 0.31 | 1.40 | 1.8 | 0.040 | 0.025 | 0.0020 | 0.010 | 0.003 | | 816 | Steel of present invention |
| 5 | 0.33 | 0.20 | 1.5 | 0.040 | 0.025 | 0.0020 | 0.015 | 0.005 | | 767 | Steel of present invention |
| 6 | 0.33 | 0.20 | 2.5 | 0.040 | 0.025 | 0.0020 | 0.015 | 0.005 | | 737 | Steel of present invention |
| 7 | 0.33 | 0.15 | 1.8 | 0.050 | 0.050 | 0.0002 | 0.090 | 0.005 | | 766 | Steel of present invention |
| 8 | 0.33 | 0.15 | 1.8 | 0.050 | 0.050 | 0.0100 | 0.090 | 0.005 | | 766 | Steel of present invention |
| 9 | 0.34 | 0.18 | 1.5 | 0.040 | 0.010 | 0.0030 | 0.010 | 0.005 | | 759 | Steel of present invention |
| 10 | 0.34 | 0.18 | 1.5 | 0.040 | 0.100 | 0.0030 | 0.010 | 0.005 | | 795 | Steel of present invention |
| 11 | 0.33 | 0.15 | 1.5 | 0.040 | 0.025 | 0.0020 | 0.090 | 0.005 | | 765 | Steel of present invention |
| 12 | 0.33 | 0.15 | 1.5 | 0.040 | 0.025 | 0.0020 | 0.001 | 0.005 | | 765 | Steel of present invention |
| 13 | 0.22 | 0.20 | 1.8 | 0.090 | 0.025 | 0.0030 | 0.010 | 0.005 | | 780 | Steel of present invention |
| 14 | 0.22 | 0.20 | 1.8 | 0.005 | 0.025 | 0.0030 | 0.010 | 0.005 | | 780 | Steel of present invention |
| 15 | 0.22 | 0.18 | 1.8 | 0.040 | 0.030 | 0.0020 | 0.010 | 0.010 | | 781 | Steel of present invention |
| 16 | 0.22 | 0.18 | 1.8 | 0.040 | 0.030 | 0.0020 | 0.010 | 0.003 | | 781 | Steel of present invention |
| 17 | 0.33 | 0.20 | 2.0 | 0.040 | 0.024 | 0.0020 | 0.010 | 0.005 | | 752 | Steel of present invention |
| 18 | 0.33 | 0.21 | 2.0 | 0.040 | 0.024 | 0.0020 | 0.010 | 0.005 | Nb: 0.05 | 752 | Steel of present invention |
| 19 | 0.33 | 0.20 | 2.0 | 0.040 | 0.025 | 0.0020 | 0.010 | 0.005 | V: 0.20 | 752 | Steel of present invention |
| 20 | 0.33 | 0.20 | 2.0 | 0.040 | 0.025 | 0.0020 | 0.010 | 0.005 | Cr: 0.20 | 752 | Steel of present invention |
| 21 | 0.33 | 0.22 | 1.9 | 0.040 | 0.022 | 0.0020 | 0.010 | 0.005 | Mo: 0.02 | 755 | Steel of present invention |
| 22 | 0.34 | 0.25 | 1.9 | 0.040 | 0.023 | 0.0020 | 0.020 | 0.005 | B: 0.003 | 755 | Steel of present invention |
| 23 | 0.33 | 0.25 | 2.0 | 0.040 | 0.022 | 0.0020 | 0.020 | 0.005 | Ni: 0.04 | 753 | Steel of present invention |
| 24 | 0.31 | 0.20 | 2.1 | 0.040 | 0.024 | 0.0020 | 0.010 | 0.005 | Mg: 0.001 | 753 | Steel of present invention |
| 25 | 0.31 | 0.20 | 2.1 | 0.040 | 0.024 | 0.0020 | 0.010 | 0.005 | Ca: 0.001, Mg: 0.001 | 753 | Steel of present invention |

TABLE 1-continued

| Steel No. | Chemical composition (mass %) Remainder Fe and impurities C | Si | Mn | sol. Al | Ti | S | P | N | Others | $Ac_3$ (° C.) | Note |
|---|---|---|---|---|---|---|---|---|---|---|---|
| 26 | 0.31 | 0.20 | 2.0 | 0.040 | 0.024 | 0.0020 | 0.010 | 0.005 | REM: 0.001, Co: 0.005 | 756 | Steel of present invention |
| 27 | 0.17 | 0.20 | 2.0 | 0.040 | 0.022 | 0.0020 | 0.010 | 0.005 | | 784 | Comparative steel |
| 28 | 0.52 | 0.20 | 2.0 | 0.040 | 0.022 | 0.0020 | 0.010 | 0.005 | | 721 | Comparative steel |
| 29 | 0.23 | 1.60 | 1.8 | 0.050 | 0.023 | 0.0020 | 0.010 | 0.005 | | 839 | Comparative steel |
| 30 | 0.22 | 0.20 | 1.3 | 0.050 | 0.025 | 0.0040 | 0.009 | 0.005 | | 795 | Comparative steel |
| 31 | 0.49 | 0.20 | 2.6 | 0.050 | 0.025 | 0.0040 | 0.009 | 0.005 | | 709 | Comparative steel |
| 32 | 0.22 | 0.20 | 2.0 | 0.040 | 0.020 | 0.0130 | 0.010 | 0.005 | | 772 | Comparative steel |
| 33 | 0.22 | 0.20 | 1.6 | 0.040 | 0.008 | 0.0010 | 0.010 | 0.005 | | 779 | Comparative steel |
| 34 | 0.22 | 0.20 | 1.6 | 0.040 | 0.110 | 0.0010 | 0.010 | 0.005 | | 820 | Comparative steel |
| 35 | 0.22 | 0.20 | 2.0 | 0.040 | 0.020 | 0.0010 | 0.110 | 0.005 | | 772 | Comparative steel |
| 36 | 0.33 | 0.20 | 1.8 | 0.110 | 0.020 | 0.0030 | 0.020 | 0.005 | | 756 | Comparative steel |
| 37 | 0.22 | 0.20 | 1.8 | 0.020 | 0.030 | 0.0030 | 0.020 | 0.015 | | 782 | Comparative steel |
| 38 | 0.33 | 1.20 | 1.9 | 0.040 | 0.025 | 0.0020 | 0.010 | 0.005 | | 800 | Steel of present invention |
| 39 | 0.33 | 1.00 | 2.0 | 0.040 | 0.025 | 0.0020 | 0.010 | 0.005 | | 788 | Steel of present invention |

An underline represents that a condition is out of the range of the present invention.

TABLE 2

| Manufacture No. | Steel No. | Hot stamping: Heating temperature (° C.) | Heating time (s) | Average cooling rate until 250° C. (° C./s) | Contact pressure P (MPa) | Steel sheet Martensite (area %) | Galvanized layer: Presence/absence of Γ phase | Cross-sectional area ratio of voids (%) | Mechanical properties Tensile strength (MPa) |
|---|---|---|---|---|---|---|---|---|---|
| 1 | 1 | 880 | 120 | 130 | 100 | 100 | Presence | 7.0 | 1505 |
| 2 | 2 | 820 | 90 | 110 | 100 | 100 | Presence | 3.0 | 2480 |
| 3 | 3 | 850 | 60 | 130 | 100 | 100 | Presence | 5.1 | 1950 |
| 4 | 4 | 850 | 60 | 130 | 100 | 100 | Presence | 5.5 | 1920 |
| 5 | 5 | 880 | 120 | 130 | 100 | 100 | Presence | 7.5 | 2045 |
| 6 | 6 | 830 | 90 | 110 | 100 | 100 | Presence | 4.0 | 2030 |
| 7 | 7 | 850 | 60 | 120 | 100 | 100 | Presence | 5.1 | 1980 |
| 8 | 8 | 850 | 60 | 120 | 100 | 100 | Presence | 5.0 | 1975 |
| 9 | 9 | 920 | 60 | 150 | 100 | 100 | Presence | 14.2 | 2100 |
| 10 | 10 | 950 | 60 | 150 | 100 | 100 | Presence | 13.5 | 1980 |
| 11 | 11 | 880 | 90 | 130 | 100 | 100 | Presence | 8.3 | 2025 |
| 12 | 12 | 880 | 90 | 130 | 100 | 100 | Presence | 7.9 | 2035 |
| 13 | 13 | 830 | 60 | 100 | 100 | 100 | Presence | 3.3 | 1520 |
| 14 | 14 | 830 | 60 | 110 | 100 | 100 | Presence | 2.9 | 1545 |
| 15 | 15 | 830 | 90 | 100 | 100 | 95 | Presence | 3.5 | 1540 |
| 16 | 16 | 830 | 120 | 100 | 100 | 100 | Presence | 3.0 | 1550 |
| 17 | 17 | 830 | 60 | 100 | 100 | 100 | Presence | 3.9 | 2030 |
| 18 | 18 | 830 | 120 | 110 | 100 | 100 | Presence | 3.3 | 2020 |
| 19 | 19 | 830 | 120 | 120 | 100 | 100 | Presence | 4.0 | 2050 |
| 20 | 20 | 830 | 120 | 100 | 100 | 100 | Presence | 3.3 | 1980 |
| 21 | 21 | 830 | 120 | 100 | 100 | 100 | Presence | 4.0 | 2010 |
| 22 | 22 | 830 | 120 | 120 | 100 | 100 | Presence | 4.4 | 2040 |
| 23 | 23 | 830 | 120 | 100 | 100 | 100 | Presence | 4.1 | 2050 |
| 24 | 24 | 830 | 120 | 100 | 100 | 100 | Presence | 3.9 | 1995 |
| 25 | 25 | 830 | 120 | 100 | 100 | 100 | Presence | 4.0 | 2010 |

| Manufacture No. | Mechanical properties: Appropriate current range (kA) | 4 √t current $I_0$ (kA) | $I_a$ (kA) | $I_a$ × 1.10 (kA) | $I_a$ × 1.15 (kA) | Electrode sticking current $I_a$ (kA) | Determination of spot weldability | Note |
|---|---|---|---|---|---|---|---|---|
| 1 | 1.40 | 5.80 | 8.12 | 8.93 | 9.34 | 10.00 | Good | Steel of present invention |
| 2 | 1.20 | 5.70 | 7.98 | 8.78 | 9.18 | 10.00 | Good | Steel of present invention |

TABLE 2-continued

| | | | | | | | | |
|---|---|---|---|---|---|---|---|---|
| 3 | 1.50 | 5.80 | 8.12 | 8.93 | 9.34 | 10.00 | Good | Steel of present invention |
| 4 | 1.50 | 5.80 | 8.12 | 8.93 | 9.34 | 9.50 | Good | Steel of present invention |
| 5 | 1.30 | 6.00 | 8.40 | 9.24 | 9.66 | 10.00 | Good | Steel of present invention |
| 6 | 1.80 | 5.70 | 7.98 | 8.78 | 9.18 | 10.00 | Good | Steel of present invention |
| 7 | 1.40 | 5.60 | 7.84 | 8.62 | 9.02 | 10.00 | Good | Steel of present invention |
| 8 | 1.40 | 5.80 | 8.12 | 8.93 | 9.34 | 10.00 | Good | Steel of present invention |
| 9 | 0.90 | 6.00 | 8.40 | 9.24 | 9.66 | 9.50 | Fair | Steel of present invention |
| 10 | 0.20 | 6.40 | 8.96 | 9.86 | 10.30 | 10.00 | Fair | Steel of present invention |
| 11 | 1.20 | 5.90 | 8.26 | 9.09 | 9.50 | 10.00 | Good | Steel of present invention |
| 12 | 1.20 | 5.80 | 8.12 | 8.93 | 9.34 | 9.50 | Good | Steal of present invention |
| 13 | 1.60 | 5.60 | 7.84 | 8.62 | 9.02 | 10.40 | Good | Steel of present invention |
| 14 | 1.70 | 5.80 | 8.12 | 8.93 | 9.34 | 10.00 | Good | Steel of present invention |
| 15 | 1.60 | 5.80 | 8.12 | 8.93 | 9.34 | 10.00 | Good | Steel of present invention |
| 16 | 1.50 | 6.00 | 8.40 | 9.24 | 9.66 | 10.50 | Good | Steel of present invention |
| 17 | 1.80 | 5.70 | 7.98 | 8.78 | 9.18 | 10.50 | Good | Steel of present invention |
| 18 | 1.70 | 5.80 | 8.12 | 8.93 | 9.34 | 10.50 | Good | Steel of present invention |
| 19 | 1.70 | 5.60 | 7.84 | 8.62 | 9.02 | 9.50 | Good | Steel of present invention |
| 20 | 1.70 | 5.90 | 8.26 | 9.09 | 9.50 | 10.00 | Good | Steel of present invention |
| 21 | 1.70 | 6.00 | 8.40 | 9.24 | 9.66 | 10.00 | Good | Steel of present invention |
| 22 | 1.80 | 5.70 | 7.98 | 8.78 | 9.18 | 10.00 | Good | Steel of present invention |
| 23 | 1.90 | 5.70 | 7.98 | 8.78 | 9.18 | 9.90 | Good | Steel of present invention |
| 24 | 1.70 | 5.90 | 8.26 | 9.09 | 9.50 | 10.00 | Good | Steel of present invention |
| 25 | 1.70 | 5.80 | 8.12 | 8.93 | 9.34 | 10.00 | Good | Steel of present invention |

TABLE 3

| Manufacture No. | Steel No. | Hot stamping: Heating temperature (° C.) | Hot stamping: Heating time (s) | Hot stamping: Average cooling rate until 250° C. (° C./s) | Hot stamping: Contact pressure P (MPa) | Steel sheet Martensite (area %) | Galvanized layer: Presence/absence of Γ phase | Galvanized layer: Cross-sectional area ratio of voids (%) | Mechanical properties Tensile strength (MPa) |
|---|---|---|---|---|---|---|---|---|---|
| 26 | 26 | 830 | 120 | 100 | 100 | 100 | Presence | 4.4 | 2000 |
| 27 | 27 | 850 | 120 | 120 | 100 | 100 | Presence | 5.2 | 1475 |
| 28 | 28 | 850 | 120 | 130 | 100 | 100 | Presence | 6.1 | 2550 |
| 29 | 29 | 820 | 120 | 110 | 100 | 30 | Presence | 3.2 | 1380 |
| 30 | 30 | 820 | 90 | 120 | 100 | 90 | Presence | 2.7 | 1480 |
| 31 | 31 | 920 | 60 | 120 | 100 | 100 | Presence | 15.5 | 2570 |
| 32 | 32 | 810 | 90 | 110 | 100 | 90 | Presence | 2.8 | 1480 |
| 33 | 33 | 810 | 90 | 110 | 100 | 85 | Presence | 1.2 | 1310 |
| 34 | 34 | 810 | 90 | 120 | 100 | 30 | Presence | 1.5 | 1150 |
| 35 | 35 | 810 | 90 | 110 | 100 | 85 | Presence | 1.9 | 1340 |
| 36 | 36 | 900 | 180 | 110 | 100 | 80 | Absence | 3.3 | 1790 |
| 37 | 37 | 810 | 90 | 100 | 100 | 95 | Presence | 2.4 | 1490 |
| 38 | 18 | 780 | 120 | 100 | 100 | 10 | Presence | 3.2 | 1000 |
| 39 | 18 | 960 | 60 | 140 | 100 | 100 | Presence | 15.4 | 2150 |
| 40 | 18 | 800 | 30 | 100 | 100 | 30 | Presence | 1.2 | 1380 |
| 41 | 18 | 830 | 630 | 100 | 100 | 100 | Absence | 4.5 | 2120 |
| 42 | 17 | 850 | 120 | 15 | 100 | 20 | Presence | 6.0 | 1240 |
| 43 | 17 | 920 | 90 | 120 | 40 | 100 | Presence | 18.0 | 2110 |
| 44 | 38 | 850 | 60 | 100 | 100 | 100 | Presence | 9.0 | 2020 |
| 45 | 39 | 850 | 60 | 100 | 100 | 100 | Presence | 8.2 | 2040 |
| 46 | 17 | 850 | 60 | 50 | 100 | 97 | Presence | 4.0 | 2000 |
| 47 | 18 | 850 | 60 | 50 | 100 | 98 | Presence | 5.3 | 2010 |
| 48 | 17 | 850 | 60 | 30 | 100 | 96 | Presence | 4.4 | 1980 |
| 49 | 18 | 850 | 60 | 30 | 100 | 96 | Presence | 4.5 | 1990 |

| Manufacture No. | Mechanical properties: Appropriate current range (kA) | Mechanical properties: 4 √t current $I_0$ (kA) | Mechanical properties: $I_a$ (kA) | Mechanical properties: $I_a \times 1.10$ (kA) | Mechanical properties: $I_a \times 1.15$ (kA) | Mechanical properties: Electrode sticking current $I_a$ (kA) | Mechanical properties: Determination of spot weldability | Note |
|---|---|---|---|---|---|---|---|---|
| 26 | 1.70 | 5.80 | 8.12 | 8.93 | 9.34 | 10.00 | Good | Example of present invention |
| 27 | 1.30 | 6.00 | 8.40 | 9.24 | 9.66 | 10.00 | Good | Comparative Example |
| 28 | 1.10 | 5.90 | 8.26 | 9.09 | 9.50 | 9.50 | Fair | Comparative Example |
| 29 | 1.60 | 5.90 | 8.26 | 9.09 | 9.50 | 10.50 | Good | Comparative Example |
| 30 | 1.70 | 5.70 | 7.98 | 8.78 | 9.18 | 10.50 | Good | Comparative Example |
| 31 | 0.20 | 6.20 | 8.68 | 9.55 | 9.98 | 9.00 | Bad | Comparative Example |
| 32 | 1.50 | 6.00 | 8.40 | 9.24 | 9.66 | 10.00 | Good | Comparative Example |
| 33 | 1.70 | 6.00 | 8.40 | 9.24 | 9.66 | 9.90 | Good | Comparative Example |
| 34 | 1.70 | 5.50 | 7.70 | 8.47 | 8.86 | 9.50 | Good | Comparative Example |
| 35 | 1.70 | 5.70 | 7.98 | 8.78 | 9.18 | 10.00 | Good | Comparative Example |
| 36 | — | 6.00 | 8.40 | 9.24 | 9.66 | 9.40 | Fair | Comparative Example |
| 37 | 1.30 | 5.70 | 7.98 | 8.78 | 9.18 | 10.00 | Good | Comparative Example |
| 38 | 1.80 | 5.80 | 8.12 | 8.93 | 9.34 | 11.00 | Good | Comparative Example |
| 39 | — | 6.30 | 8.82 | 9.70 | 10.14 | 8.50 | Bad | Comparative Example |
| 40 | 1.70 | 5.70 | 7.98 | 8.78 | 9.18 | 10.00 | Good | Comparative Example |
| 41 | — | 6.10 | 8.54 | 9.39 | 9.82 | 9.50 | Fair | Comparative Example |
| 42 | 1.30 | 5.60 | 7.84 | 8.62 | 9.02 | 9.50 | Good | Comparative Example |
| 43 | — | 6.00 | 8.40 | 9.24 | 9.66 | 8.50 | Bad | Comparative Example |

TABLE 3-continued

| | | | | | | | | |
|---|---|---|---|---|---|---|---|---|
| 44 | 1.40 | 5.80 | 8.12 | 8.93 | 9.34 | 10.00 | Good | Example of present invention |
| 45 | 1.50 | 5.80 | 8.12 | 8.93 | 9.34 | 10.00 | Good | Example of present invention |
| 46 | 1.60 | 5.80 | 8.12 | 8.93 | 9.34 | 10.50 | Good | Example of present invention |
| 47 | 1.70 | 5.90 | 8.26 | 9.09 | 9.50 | 10.00 | Good | Example of present invention |
| 48 | 1.60 | 6.00 | 8.40 | 9.24 | 9.66 | 10.00 | Good | Example of present invention |
| 49 | 1.60 | 5.80 | 8.12 | 8.93 | 9.34 | 10.00 | Good | Example of present invention |

An underline represents that a condition is out of the range of the present invention, a manufacturing condition is not preferred, or properties are not preferred.

It is found from Tables 2 and 3 that a hot-stamping formed body of which the chemical composition and microstructure of a steel sheet and the layer structure and cross-sectional area ratio of voids of a zinc-plated layer are in the range of the present invention has a tensile strength in a range of 1500 MPa to 2500 MPa and is excellent in spot weldability.

On the other hand, it is found that a hot-stamping formed body of which any one or more of the chemical composition and microstructure of a steel sheet and the layer structure and cross-sectional area ratio of voids of a zinc-plated layer are out of the present invention has a tensile strength out of a range of 1500 MPa to 2500 MPa and/or is inferior in spot weldability. Manufacture No. 36, 39, 41, and 43 are examples in which expulsion occurred before current reaches the current $I_0$ at which a nugget diameter was $4\sqrt{t}$.

INDUSTRIAL APPLICABILITY

According to the aspect of the present invention, it is possible to obtain a hot-stamping formed body that is excellent in spot weldability and has strength generally required for a hot-stamping formed body.

The invention claimed is:

1. A hot-stamping formed body comprising:

a steel sheet; and a zinc-plated layer that is provided on the steel sheet, wherein the steel sheet has a chemical composition consisting of, by mass %, C: 0.18% to 0.50%,
Si: 0.10% to 1.50%,
Mn: 1.5% to 2.5%,
sol.Al: 0.001% to 0.100%,
Ti: 0.010% to 0.100%,
S: 0.0100% or less,
P: 0.100% or less,
N: 0.010% or less,
Nb: 0% to 0.05%,
V: 0% to 0.50%,
Cr: 0% to 0.50%,
Mo: 0% to 0.50%,
B: 0% to 0.010%,
Ni: 0% to 2.00%, and
a total of REM, Ca, Co, and Mg: 0% to 0.030%,
a remainder consisting of Fe and impurities, an area % of martensite is 90% or more in microstructure at a position corresponding to ¼ of a sheet thickness of the steel sheet from a surface of the steel sheet in a sheet thickness direction, the zinc-plated layer includes a Γ phase and a Fe—Zn solid solution, wherein an adhesion amount of the Γ phase is 5 g/m$^2$ to 150 g/m$^2$ per side, and a cross-sectional area ratio of voids present in the zinc-plated layer is 15.0% or less.

2. The hot-stamping formed body according to claim 1, wherein the chemical composition contains, by mass %, one or two or more selected from the group of Nb: 0.02% to 0.05%,
V: 0.005% to 0.50%,
Cr: 0.10% to 0.50%,
Mo: 0.005% to 0.50%,
B: 0.0001% to 0.010%,
Ni: 0.01% to 2.00%, and
a total of REM, Ca, Co, and Mg: 0.0003% to 0.030%.

3. The hot-stamping formed body according to claim 1, wherein the chemical composition contains, by mass %, C: 0.24% to 0.50%.

4. The hot-stamping formed body according to claim 2, wherein the chemical composition contains, by mass %, C: 0.24% to 0.50%.

5. The hot-stamping formed body according to claim 1, wherein the zinc-plated layer does not include a hot-dipped galvannealed layer.

6. A hot-stamping formed body comprising:

a steel sheet; and a zinc-plated layer that is provided on the steel sheet, wherein the steel sheet has a chemical composition containing, by mass %, C: 0.18% to 0.50%,
Si: 0.10% to 1.50%,
Mn: 1.5% to 2.5%,
sol.Al: 0.001% to 0.100%,
Ti: 0.010% to 0.100%,
S: 0.0100% or less,
P: 0.100% or less,
N: 0.010% or less,
Nb: 0% to 0.05%,
V: 0% to 0.50%,
Cr: 0% to 0.50%,
Mo: 0% to 0.50%,
B: 0% to 0.010%, Ni: 0% to 2.00%, and a total of REM, Ca, Co, and Mg: 0% to 0.030%, a remainder comprising Fe and impurities, an area % of martensite is 90% or more in microstructure at a position corresponding to ¼ of a sheet thickness of the steel sheet from a surface of the steel sheet in a sheet thickness direction, the zinc-plated layer includes a Γ phase and a Fe—Zn solid solution, wherein an adhesion amount of the Γ phase is 5 $g/m^2$ to 150 $g/m^2$ per side, and a cross-sectional area ratio of voids present in the zinc-plated layer is 15.0% or less.

* * * * *